US006176030B1

(12) United States Patent
Ball

(10) Patent No.: US 6,176,030 B1
(45) Date of Patent: Jan. 23, 2001

(54) BREECH PLUG FOR A MUZZLE-LOADING FIREARM

(76) Inventor: Henry C. Ball, 1315 Fairmont, Greensboro, NC (US) 27403

( * ) Notice: Under 35 U.S.C. 154(b), the term of this patent shall be extended for 0 days.

(21) Appl. No.: 09/124,685

(22) Filed: Jul. 29, 1998

Related U.S. Application Data

(60) Continuation-in-part of application No. 08/886,296, filed on Jul. 1, 1997, now Pat. No. 5,860,240, which is a division of application No. 08/630,693, filed on Apr. 12, 1996, now Pat. No. 5,642,583, which is a division of application No. 08/317,210, filed on Oct. 3, 1994, now Pat. No. 5,511,334.

(51) Int. Cl.[7] ..... F41C 7/00; F41C 9/08
(52) U.S. Cl. ..... 42/51
(58) Field of Search ..... 42/51, 83

(56) References Cited

U.S. PATENT DOCUMENTS

| | | | | |
|---|---|---|---|---|
| 3,780,464 | | 12/1973 | Anderson | 42/69 |
| 4,123,867 | * | 11/1978 | Peterson | 42/83 |
| 4,222,191 | | 9/1980 | Lee et al. | 42/77 |
| 4,227,330 | | 10/1980 | Chapin | 42/77 |
| 4,232,468 | | 11/1980 | Chapin | 42/77 |
| 4,283,874 | | 8/1981 | Vaughn | 42/51 |
| 4,437,249 | | 3/1984 | Brown et al. | 42/51 |
| 4,700,499 | | 10/1987 | Knight | 42/51 |
| 4,912,868 | | 4/1990 | Thompson | 42/77 |
| 5,010,677 | | 4/1991 | Verney Carron | 42/77 |
| 5,109,622 | | 5/1992 | Echeberria | 42/69.02 |
| 5,133,143 | | 7/1992 | Knight | 42/51 |
| 5,408,776 | | 4/1995 | Mahn et al. | 42/51 |
| 5,487,232 | | 1/1996 | Osborne et al. | 42/51 |
| 5,511,334 | | 4/1996 | Ball et al. | 42/51 |
| 5,642,583 | | 7/1997 | Ball et al. | 42/51 |
| 5,706,598 | * | 1/1998 | Johnston | 42/51 |
| 5,860,240 | * | 1/1999 | Ball et al. | 42/51 |
| 5,907,920 | * | 6/1999 | Laney | 42/83 |

OTHER PUBLICATIONS

Knight Riffles—Hunt With A Legend; p. 7, 1993.

* cited by examiner

*Primary Examiner*—Michael J. Carone
*Assistant Examiner*—James S. Bergin
(74) *Attorney, Agent, or Firm*—Rhodes & Mason, PLLC

(57) ABSTRACT

An improved muzzle-loading firearm which is achieved by modifying the design of the breech plug to include a replaceable aperture adjacent to the firing chamber which can be easily replaced if damaged beyond repair. In the preferred embodiment, the breech plug is adapted to receive an ejectable firing module which permits loading of the firearm as a muzzle-loader, while also permitting the firing module to be inserted and ejected like a cartridge in a conventional breech loading firearm.

34 Claims, 2 Drawing Sheets

BREECH PLUG FOR A MUZZLE-LOADING FIREARM

CROSS-REFERENCE TO RELATED APPLICATIONS

This application is a continuation-in-part of U.S. Ser. No. 08/886,296, filed Jul. 1, 1997, now U.S. Pat. No. 5,860,240, issued Jan. 19, 1999, which, in turn is a divisional of U.S. Ser. No. 08/630,693, filed Apr. 12, 1996, now U.S. Pat. No. 5,642,583, issued Jul. 1, 1997, which, in turn is a divisional of U.S. Ser. No. 08/317,210, filed Oct. 3, 1994, now U.S. Pat. No. 5,511,334, issued Apr. 30, 1996.

BACKGROUND OF THE INVENTION (1) Field of the Invention

The present invention relates generally to firearms and, more particularly, to an improved breech plug for a muzzle-loading firearm.

(2) Description of the Prior Art

Modern breech-loading firearms, such as rifles, include a barrel having an axial bore, a stock to support the barrel, and a receiver at the breech end of the barrel. The receiver is comprised of a housing which includes a chamber for insertion of a cartridge into the breech of the barrel, a means for firmly securing the cartridge in the breech of the barrel in a sealed and locked position, a firing pin to discharge the cartridge primer, a trigger to move the firing pin into engagement with the cartridge primer, and an ejector to remove the cartridge after firing.

Muzzle-loading rifles and other muzzle-loading firearms are also comprised of a barrel with an axial bore and a supporting stock. However, a muzzle-loading rifle is loaded by inserting a charge of powder, wadding and shot through the muzzle end of the barrel and tamping the charge securely into the breech end of the barrel. The powder is then ignited, e.g., by striking a percussion cap, which sends a flame, normally through a small opening or flame bore, into the breech of the barrel through a breech plug which separates the primer from the powder charge.

Muzzle-loading rifles have several disadvantages in comparison with breech-loading cartridge rifles. They are more difficult and time consuming to load, and require greater skill to use. Malfunctions are more common due to the relatively more complex firing mechanisms required to ignite the powder. Muzzle-loading rifles are effected by inclement weather, particularly rain and moisture which affects the powder and causes the rifle to misfire. Muzzle-loading rifles must also be cleaned thoroughly to prevent clogging and corrosion by the powder residue.

Despite these disadvantages, many hunters and firearms enthusiasts prefer to use muzzle-loading firearms, at least on some occasions, due to the nostalgia and the sport which the muzzle-loaders afford. In addition, many states allow a longer hunting season and special hunting areas for muzzle-loading firearms, due to the greater challenge provided and, consequently, the much smaller number of animals taken.

Various designs have been proposed for the construction of improved muzzle-loading rifles. For example, U.S. Pat. No. 4,700,499 to Knight discloses a muzzle loading rifle that uses a "nut cracker" type of action to fire a conventional percussion cap.

U.S. Pat. No. 3,780,464 to Anderson and U.S. Pat. No. 4,283,874 to Vaughan disclose mechanisms for replacing the flash hole structure in breech or muzzle loading firearms to allow firing with modern metallic cartridge primers. Both inventions use a cap covering to hold the primer in place until firing.

U.S. Pat. Nos. 4,227,330 and 4,232,468 to Chapin disclose a conversion plug that can be configured to be removably inserted into the breech of a breech loading firearm to convert the firearm into a muzzle loading type. The conversion plug includes a primer cap receiving chamber which communicates with the bore of the rifle through a flash hole.

U.S. Pat. Nos. 4,222,191 to Lee et al; U.S. Pat. No 4,437,249 to Brown et al; and U.S. Pat. No 5,010,677 to Carron all disclose variations of the Chapin type of conversion plug for converting a shotgun or rifle into a muzzle loader.

U.S. Pat. Nos. 5,511,334 and 5,642,583, issued to Ball et al., disclose a way to convert a modern breech lock, cartridge rifle into a rifle that can be used as a muzzle-loading rifle. The disclose of these patents are hereby incorporated by reference in their entirety. However, even in this design the flame bore extending through the breech plug can become clogged or corroded after repeated use. This may require that the entire breech plug be replaced at some expense.

Thus, there remains a need for a new and improved breech plug for a muzzle-loading rifle which can be more easily cleaned after use while, at the same time, utilizes a replaceable aperture adjacent to the firing chamber which can be easily replaced if damaged beyond repair.

SUMMARY OF THE INVENTION

The present invention is directed to an improved muzzle-loading firearm which is achieved by modifying the design of the breech plug to include a replaceable aperture adjacent to the firing chamber which can be easily replaced if damaged beyond repair. In the preferred embodiment, the breech plug is adapted to receive an ejectable firing module, such as disclosed in the above-referenced Ball patents which permits loading of the firearm as a muzzle-loader, while also permitting the firing module to be inserted and ejected like a cartridge in a conventional breech loading firearm.

Thus, in the preferred embodiment, the muzzle-loading rifle of the present invention is comprised of a barrel into which powder, wadding and ball are loaded through the muzzle or discharge end in a conventional manner, a breech loading receiver attached to the breech or rear end of the barrel, and a breech plug within the breech end of the barrel adapted to receive a firing module having the shape of a conventional cartridge wherein the breech plug includes a replaceable aperture.

The receiver of the present invention may be of a variety of designs used in modern rifles, and may be a bolt action, a lever action, a rolling block or a semi-automatic design. In either case, the receiver will be comprised of a housing, a firing mechanism movable between an open position and a closed and firing position, a firing pin, a firing mechanism to strike the firing pin, and an ejector designed to eject a spent cartridge after firing. The housing may be threaded to attach a barrel.

The barrel may have external annular threads at its breech end for attachment to the receiver housing. In accordance with the present invention, the barrel is drilled and tapped at its breech end to form internal plug engaging threads to secure the breech plug.

The breech plug is comprised of a cylindrical rear section and an axially aligned and integral, cylindrical front section. The rear section, which is preferably of a larger diameter than the barrel bore, is externally threaded to engage the internal threads of the barrel bore. The front section has an external diameter equal to the internal diameter of the barrel bore, and is adapted to snugly fit within the barrel bore when the breech plug is threaded into the barrel breech. At least a portion of the flame bore adjacent to the firing chamber includes a replaceable aperture which can be removed for cleaning or replaced if damaged beyond repair. The rear face of the breech plug is perpendicular to the axis of the plug. The breech plug shape may also be modified to accommodate the particular configuration of the firearm being modified. For example, the face of the plug may need to be configured to receive the cartridge ejector.

In the preferred embodiment, a cylindrical firing module receiving chamber, axially aligned with the barrel bore, extends from the rear face of the breech plug. The firing module receiving chamber is formed of a continuous interior cylindrical wall, terminating in a tapered or conical inner face, which tapers inwardly to mate with a firing module. The length of the chamber is sufficient to accommodate the firing module, with only the ejection rim of the module extending from the chamber. The flame bore is axially aligned with the firing module receiving plug and extends between and communicates with the firing module receiving plug and the barrel bore, providing a passageway for a flame to travel from the firing module within the chamber to the barrel bore, and thus ignite powder within the breech of the barrel. In the preferred embodiment, the flame bore tapers radially outwardly at its forward end to form a powder receiving chamber.

The firing module itself is preferably comprised of a thick cylindrical wall surrounding a central, axially aligned flame bore having a uniform diameter. The firing module terminates at its rear end in a vertical rear face, and is tapered at its forward end to engage the tapered inner face of the firing module receiving plug. An annular shoulder extends around the periphery of the firing module proximate to the module's rear face to create a radial ejection flange or rim adjacent the rear face of the firing module. The overall length of the module will depend on the design of the particular firearm. An igniter receiving chamber is recessed into the rear face of the firing module and is axially aligned with the flame bore. The chamber is of a shape and dimension such that it will snugly hold a commercially available igniter, such as a primer cap or a percussion cap. An igniter is fitted snugly into the chamber.

Accordingly, one aspect of the present invention is to provide a muzzle-loading firearm including: (a) a breech loading receiver including a firing mechanism movable between an open position and a firing position; (b) a barrel having a breech end engaging said receiver and a bore extending from said breech end for receiving a powder charge; and (c) a breech plug within the breech of said barrel having a breech end aligned with the breech end of said barrel and a barrel bore end aligned with the bore end of said barrel, said breech plug further including: (i) an igniter receiver positioned at the breech end of said breech plug; (ii) a flame bore extending from said igniter receiver to the barrel bore end of said breech plug; and (iii) a replaceable aperture at the barrel bore end of said flame bore, said aperture being aligned with said flame bore to allow a flame front to be distributed to a powder charge.

Another aspect of the present invention is to provide a breech plug for use in a muzzle-loading firearm, said breech plug including: (a) an igniter receiver positioned at the breech end of said breech plug; (b) a flame bore extending from said igniter receiver to the barrel bore end of said breech plug; and (c) a threaded plug positioned at said barrel bore end of said breech plug, said threaded plug including an aperture aligned with said flame bore to allow a flame front to be distributed to a powder charge.

Still another aspect of the present invention is to provide a muzzle-loading firearm including: (a) a breech loading receiver including a firing mechanism movable between an open position and a firing position; (b) a barrel having a breech end engaging said receiver and a bore extending from said breech end for receiving a powder charge; and (c) a breech plug within the breech of said barrel having a breech end aligned with the breech end of said barrel and a barrel bore end aligned with the bore end of said barrel, said breech plug further. including: (i) an igniter receiver positioned at the breech end of said breech plug; (ii) a flame bore extending from said igniter receiver to the barrel bore end of said breech plug; (iii) a threaded plug positioned at said barrel bore end of said breech plug, said threaded plug including an aperture aligned with said flame bore to allow a flame front to be distributed to a powder charge; and (iv) a firing module receiving chamber for receiving a firing module.

These and other aspects of the present invention will become apparent to those skilled in the art after a reading of the following description of the preferred embodiment when considered with the drawings.

DESCRIPTION OF THE PREFERRED EMBODIMENTS

Figure 1:
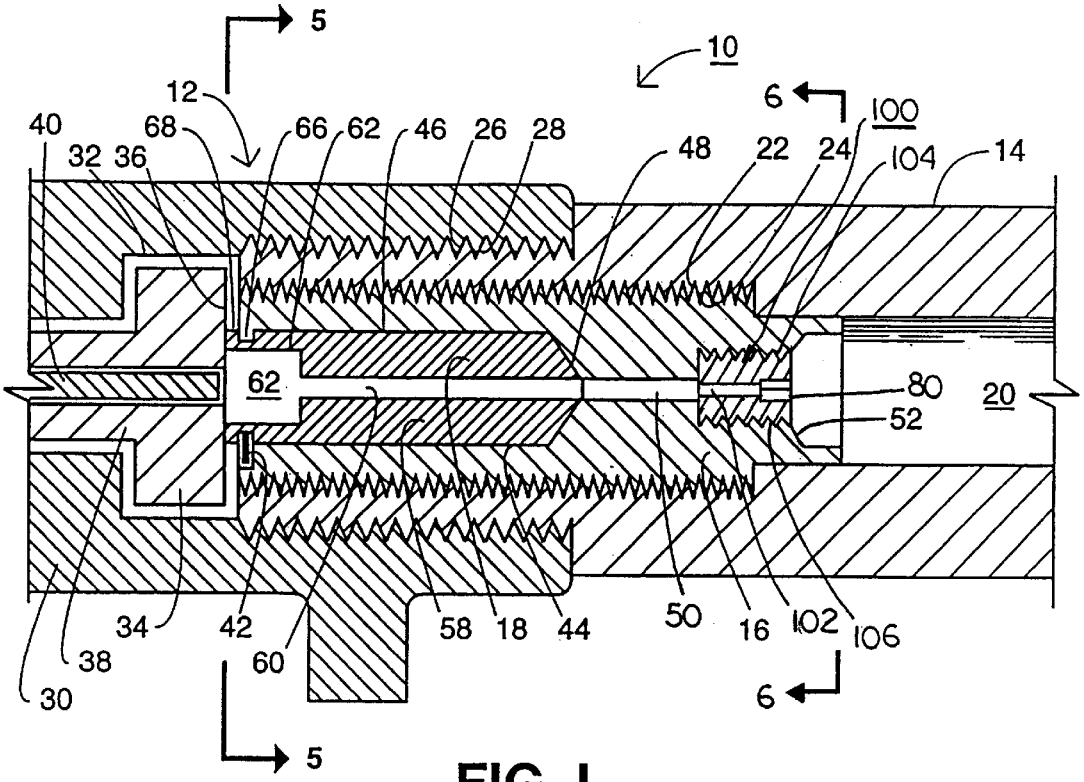
FIG. 1 is a cross-sectional view of a muzzle-loading rifle including a breech plug constructed in accordance with the present invention loaded with a preferred firing module in firing position.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. As best seen in FIG. 1, there is shown a muzzle-loading firearm, generally designated 10, showing part of a receiver 12 and a barrel 14 of a conventional bolt action rifle which has been modified for muzzle-loading by plugging the breech of barrel 14 with a breech plug 16 adapted to receive a firing module 18 shown inserted into breech plug 16.

Barrel 14 includes a central axial bore 20 which extends from the breech end of barrel 14 to the muzzle or discharge end of the rifle. The breech end of barrel 14 is internally threaded with threads 22 to receive breech plug 16, which is externally threaded along a rear section with threads 24 which engage threads 22. The exterior surface of the breech end of barrel 14 is also threaded with threads 26 to engage an internally threaded opening 28 in receiver housing 30.

Receiver housing 30 also includes a bolt bore 32 axially aligned with barrel bore 20 to slidably receive a bolt 34 which is moveable between an open position and a closed and locked position. Bolt 34 includes a bolt face 36 and an axial bore 38 which slidably receives a firing pin 40. An ejector 42 is positioned in front of bolt 34.

Figure 5:
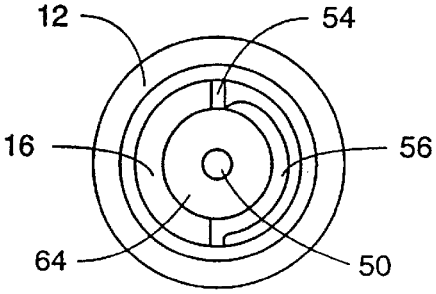
FIG. 5 is an end view of the breech plug taken along line 5—5 in FIG. 1.

The breech plug 16 is comprised of a central, axially aligned, firing module receiving recess or chamber 44 formed of a cylindrical side wall 46 and an inwardly tapered front wall 48. Wall 48 is tapered to provide a larger surface for engagement with the forward end of firing module 18, thus producing a better seal. A central, axially aligned flame bore 50 extends from the center of front wall 48 to barrel bore 20, and terminates in an outwardly tapered front wall 52. The front section of plug 16 is threaded into barrel 14. The face of plug 16 that is adjacent the bolt and firing pin when inserted into the firearm, as best seen in FIG. 5, includes a radial slot 54 to facilitate insertion and removal of plug 16 into barrel 14, and an ejector receiving slot 56, which allows ejector 42 to engage firing module 18 for extraction.

Figure 6:
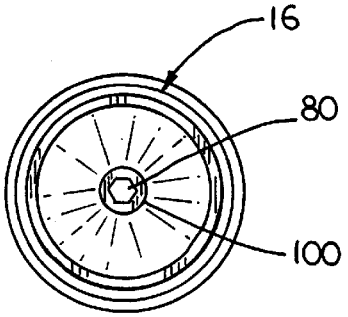
FIG. 6 is an end view of the breech plug taken along line 6—6 in FIG. 1.
Figure 7:
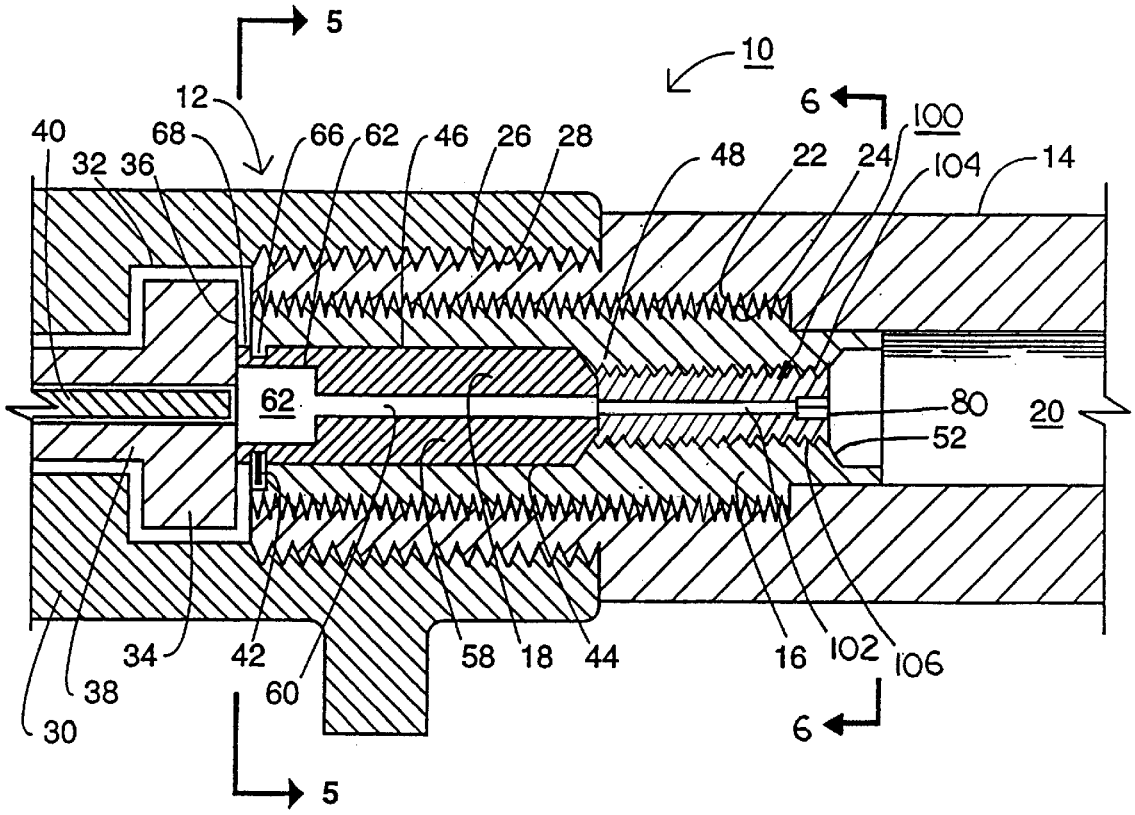
FIG. 7 is a cross-sectional view of a muzzle-loading rifle including an alternative embodiment of the breech plug constructed in accordance with the present invention loaded with a preferred firing module in firing position, wherein the threaded plug extends the entire length of the flame bore.

A central, axially aligned passageway extends between the ignition chamber and barrel bore to provide for the spark to travel from the ignition chamber to the powder. The passageway includes a flame bore 50 and an outwardly tapered front wall 52. The front, barrel bore end of the flame bore 50 includes a threaded plug 100 having an aperture 102 that aligns with the flame bore. In the preferred embodiment, the diameter of the aperture 102 is about equal to the diameter of the flame bore 50. The threaded plug 100 has external threads 104 which mate with internal threads 106 on the interior of the breech plug. A tool cavity 80 for receiving a tool for installation or removal of the threaded plug is positioned at the front end of the threaded plug 100. As best seen in FIG. 6, the preferred embodiment of the present invention includes a tool cavity 80 sized for insertion of an Allen wrench. The opposite end of the plug may include fins, similar to a star lock washer, to help prevent the plug from working loose.

The threaded plug 100 with aperture 102 is designed and used to preserve the integrity of the front, barrel bore end of flame bore 50 diameter. After substantial firings, the aperture 102 may wear and become larger thereby reducing the possibility of ignition of the powder because of excessive disbursement of the spark. Routine maintenance in which the threaded plug 100 is replaced insures the integrity of the flame bore and proper disbursement of the spark for ignition. The threaded plug illustrated in FIG. 1 extends only a portion of the flame bore 50 where most damage occurs. However, it is understood that this invention contemplates a threaded plug having any length up to the full length of the flame bore.

Figure 2:
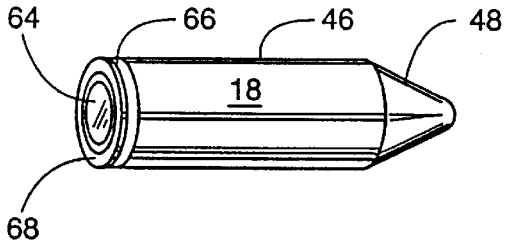
FIG. 2 is a perspective view of the preferred firing module.

The preferred firing module, shown in FIGS. 1 and 2, is comprised of a thick cylindrical wall 58 around a central, axially aligned, flame bore 60. An axially aligned igniter recess or chamber 62 extends inwardly from the breech end of firing module 18. Flame bore 60 extends from the inner face of igniter chamber 62 to flame bore 50 in plug 16, to form a flame passageway from igniter chamber 62 to barrel bore 20. Igniter chamber 62 is sized to snugly receive a primer cap 64, such as a conventional shotgun primer cap, and includes an annular shoulder to receive the annular rim of cap 64, so that the face of cap 64 is flush with the face of firing module 18. An annular shoulder 66 extends around firing module 18 to form a radial ejector flange 68.

Figure 3:
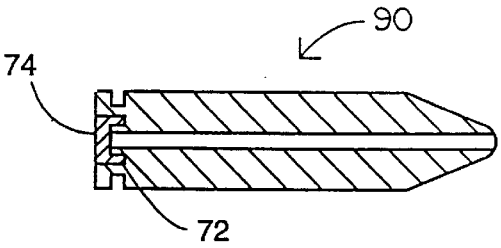
FIG. 3 is a cross-sectional view of an alternative embodiment of the firing module using a percussion cap as the igniter.
Figure 4:
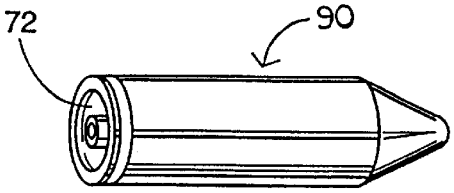
FIG. 4 is a perspective view of the alternative firing module shown in FIG. 3 with the percussion cap removed.

An alternative embodiment of a firing module 90 is shown in FIGS. 3 and 4. This alternative module differs from the preferred firing module 18 in that the igniter chamber is comprised of an annular shoulder 72, which is adapted to receive a conventional, low pressure percussion cap 74, such as is normally used in black powder firearms. This type of firing module is for use by hunters in areas where the law may require the use of low pressure percussion only.

In operation, the rifle is first loaded by inserted powder, wadding and shot into bore 20. The powder is tamped into the flared end 52 of flame bore 50. Then, for safety, firing module 18 is chambered into chamber 44 of plug 16 and bolt 34 is moved to the forward closed and locked position with bolt face 36 tightly in engagement with the rear face of firing module 18. The rifle is then fired in a conventional manner, e.g., by pulling a trigger, not shown, to bring the end of firing pin 40 into engagement with primer cap 64, producing a flame which travels through flames bores 60, 50, and 52 to ignite the powder in bore 20, thereby propelling the bullet or shot from barrel 14. Spent firing module 18 is then ejected in the same manner as one would remove a spent cartridge from a modern breech loading cartridge rifle by withdrawing bolt 34 to open the receiver chamber and withdrawing firing module 18 from chamber 46 with ejector 42, which engages firing module 18 by moving into shoulder 66 and then moving rearwardly, pushing against ejector rim or flange 68. Module 90 can be used instead of module 18, and is fired and ejected in the same manner.

Periodic maintenance may include removing the breech plug 16 from the breech of the barrel 14, such as by inserting a screw driver between radial slots 54. The threaded plug 100 may be removed from the front, barrel bore end of the flame bore 50 by inserting a tool such as an Allen wrench into the tool cavity. A replacement threaded plug 100 may then be inserted to maintain the flame bore 50 and ensure adequate spark distribution to the powder. The breech plug 16 may then be replaced into the barrel 14.

Certain modifications and improvements will occur to those skilled in the art upon a reading of the foregoing description. While the firearm of the present invention has been described in terms of the modification of an existing rifle, the invention is also applicable to other breech loading, locking firearms, such as muzzle-loading handguns and shotguns. It should be understood that all such modifications and improvements have been deleted herein for the sake of conciseness and readability but are properly within the scope of the follow claims.

I claim:

1. A muzzle-loading firearm comprising:

(a) a breech loading receiver including a firing mechanism movable between an open position and a firing position;

(b) a barrel having a breech end engaging said receiver and a bore extending from said breech end for receiving a powder charge; and (c) a breech plug within the breech of said barrel having a breech end aligned with the breech end of said barrel and a barrel bore end aligned with the bore end of said barrel, said breech plug further including:

(i) an igniter receiver positioned at the breech end of said breech plug;

(ii) a flame bore extending from said igniter receiver to the barrel bore end of said breech plug; and (iii) a replaceable aperture separatable from the barrel bore end of said breech plug, said aperture being aligned with said flame bore to allow a flame front to be distributed to a powder charge.

2. The apparatus according to claim 1, wherein said breech plug further including a firing module receiving chamber for receiving a firing module.

3. The apparatus according to claim 2, wherein said module receiving chamber is axially aligned with the bore of said barrel and said flame bore extends from said module receiving chamber to the bore of said barrel.

4. The apparatus according to claim 2, wherein the firing mechanism of said breech loading receiver includes a bolt having a face adapted to engage said firing module.

5. The apparatus according to claim 2, wherein said receiver includes a firing pin positioned to discharge said firing module.

6. The apparatus according to claim 2, wherein said firing module is tapered at its forward end at a given angle and said module receiving chamber is tapered at a complementary angle to said given angle at its forward end.

7. The apparatus according to claim 2, further including an ejector adapted to eject said firing module from said receiver.

8. The apparatus according to claim 1, wherein said breech plug is externally threaded along a part of its length and said barrel is internally threaded to receive said breech plug.

9. The apparatus according to claim 1, wherein said forward end of said breech plug has an outer circular cross section equal to the inner cross section of said barrel bore.

10. A breech plug for use in a muzzle-loading firearm, said firearm including a breech loading receiver including a firing mechanism movable between an open position and a firing position and a barrel having a breech end engaging said receiver and a bore extending from said breech end for receiving a powder charge, said breech plug comprising:

(a) an igniter receiver positioned at the breech end of said breech plug;

(b) a flame bore extending from said igniter receiver to the barrel bore end of said breech plug; and (c) a threaded plug separatable from the barrel bore end of said breech plug, said threaded plug including an aperture aligned with said flame bore to allow a flame front to be distributed to a powder charge.

11. The apparatus according to claim 10, wherein said flame bore has the same cross-section diameter throughout its length.

12. The apparatus according to claim 10, wherein said threaded plug aperture is about the same diameter as said flame bore.

13. The apparatus according to claim 10, wherein said threaded plug includes a tool cavity for installing and removing said threaded plug from said breech plug.

14. The apparatus according to claim 13, wherein said tool cavity is axially aligned with said threaded plug aperture.

15. The apparatus according to claim 10, wherein said threaded plug extends less than the entire length of said flame bore.

16. The apparatus according to claim 10, wherein said breech plug includes an outwardly tapered front wall at the barrel bore end to distribute a flame front into a powder charge.

17. The apparatus according to claim 16, wherein said front wall tapers outwardly from said threaded plug.

18. The apparatus according to claim 10, wherein said breech plug includes a radial slot at the breech end of said breech plug to facilitate insertion and removal of said breech plug.

19. A muzzle-loading firearm comprising:

(a) a breech loading receiver including a firing mechanism movable between an open position and a firing position;

(b) a barrel having a breech end engaging said receiver and a bore extending from said breech end for receiving a powder charge; and (c) a breech plug within the breech of said barrel having a breech end aligned with the breech end of said barrel and a barrel bore end aligned with the bore end of said barrel, said breech plug further including:

(i) an igniter receiver positioned at the breech end of said breech plug;

(ii) a flame bore extending from said igniter receiver to the barrel bore end of said breech plug;

(iii) a threaded plug separatable from the barrel bore end of said breech plug, said threaded plug including an aperture aligned with said flame bore to allow a flame front to be distributed to a powder charge; and (iv) a firing module receiving chamber for receiving a firing module.

20. The apparatus according to claim 19, wherein said module receiving chamber is axially aligned with the bore of said barrel and said flame bore extends from said module receiving chamber to the bore of said barrel.

21. The apparatus according to claim 19, wherein the firing mechanism of said breech loading receiver includes a bolt having a face adapted to engage said firing module.

22. The apparatus according to claim 19, wherein said receiver includes a firing pin positioned to discharge said firing module.

23. The apparatus according to claim 19, wherein said firing module is tapered at its forward end at a given angle and said module receiving chamber is tapered at a complementary angle to said given angle at its forward end.

24. The apparatus according to claim 19, wherein said breech plug is externally threaded along a part of its length and said barrel is internally threaded to receive said breech plug.

25. The apparatus according to claim 19, wherein said forward end of said breech plug has an outer circular cross section equal to the inner cross section of said barrel bore.

26. The apparatus according to claim 19, further including an ejector adapted to eject said firing module from said receiver.

27. The apparatus according to claim 19, wherein said flame bore has the same diameter cross-section throughout its length.

28. The apparatus according to claim 19, wherein said threaded plug aperture is about the same diameter as said flame bore.

29. The apparatus according to claims 19, wherein said threaded plug includes a tool cavity for installing and removing said threaded plug from said breech plug.

30. The apparatus according to claim 29, wherein said tool cavity is axially aligned with said threaded plug aperture.

31. The apparatus according to claim 19, wherein said threaded plug extends less than the entire length of said flame bore.

32. The apparatus according to claim 19, wherein said breech plug includes an outwardly tapered front wall at the barrel bore end to distribute a flame front into a powder charge.

33. The apparatus according to claim 32, wherein said front wall tapers outwardly from said threaded plug.

34. The apparatus according to claim 19, wherein said breech plug includes a radial slot at the breech end of said breech plug to facilitate insertion and removal of said breech plug.

* * * * *